US007911489B2

(12) United States Patent
Yamade et al.

(10) Patent No.: US 7,911,489 B2
(45) Date of Patent: Mar. 22, 2011

(54) THERMAL PRINT HEAD

(75) Inventors: Takumi Yamade, Kyoto (JP); Naofumi Kanei, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 16 days.

(21) Appl. No.: 12/531,361

(22) PCT Filed: Mar. 11, 2008

(86) PCT No.: PCT/JP2008/054345

§ 371 (c)(1),
(2), (4) Date: Sep. 15, 2009

(87) PCT Pub. No.: WO2008/111575

PCT Pub. Date: Sep. 18, 2008

(65) Prior Publication Data

US 2010/0066798 A1 Mar. 18, 2010

(30) Foreign Application Priority Data

Mar. 15, 2007 (JP) ..... 2007-066445

(51) Int. Cl.
*B41J 2/335* (2006.01)

(52) U.S. Cl. ..... 347/203

(58) Field of Classification Search ..... 347/203
See application file for complete search history.

(56) References Cited

U.S. PATENT DOCUMENTS

| | | | | |
|---|---|---|---|---|
| 6,175,377 | B1 * | 1/2001 | Noshita et al. | 347/203 |
| 6,330,013 | B1 * | 12/2001 | Kashiwaya et al. | 347/203 |
| 6,441,840 | B1 | 8/2002 | Sato et al. | |
| 6,445,402 | B1 | 9/2002 | Kinjyo et al. | |
| 6,469,724 | B1 * | 10/2002 | Hayashi et al. | 347/204 |
| 6,483,528 | B1 * | 11/2002 | Yamade et al. | 347/203 |
| 7,443,409 | B2 | 10/2008 | Sako | |

FOREIGN PATENT DOCUMENTS

| | | |
|---|---|---|
| JP | 63-81062 | 4/1988 |
| JP | 2000-141729 | 5/2000 |
| JP | 2000-255089 | 9/2000 |
| JP | 2000-272155 | 10/2000 |
| JP | 2002-2005 | 1/2002 |
| JP | 2005-313513 | 11/2005 |

* cited by examiner

*Primary Examiner* — Huan H Tran
(74) *Attorney, Agent, or Firm* — Hamre, Schumann, Mueller & Larson, P.C.

(57) ABSTRACT

A thermal print head A includes a substrate 1, a heat generating resistor 3 supported by the substrate 1, and a protective layer 4 which covers the heat generating resistor 3. The protective layer 4 includes a first inner layer 41 which is in contact with the heat generating resistor 3, a second inner layer 42 formed on the first inner layer 41, and an outer layer 43. Part of the second inner layer 42 is formed as a rough surface 42*a* which has a surface roughness of Ra 0.1 through 0.3. The rough surface 42*a* is disposed at a position corresponding to the heat generating resistor 3. The outer layer 43 is made of a metal nitride or a chemical compound containing a metal nitride, and has a thickness of 0.1 through 0.5 μm.

2 Claims, 3 Drawing Sheets

THERMAL PRINT HEAD

TECHNICAL FIELD

The present invention relates to a thermal print head used in a thermal printer.

BACKGROUND ART

A thermal print head is a device for printing images or characters by locally heating a printing object such as thermal paper (see Patent Document 1, for example). FIG. 4 shows an example of a conventional thermal print head. In the illustrated thermal print head X, an electrode 93 is disposed on a substrate 91 formed with a partial glaze 92, and part of the electrode extends in the secondary scanning direction. A heat-generating resistor 94, crossing the electrode 93, is formed to extend in the primary scanning direction. The heat generating resistor 94 is covered by a protective layer 95. Current is applied to the heat generating resistor 94 via the electrode 93 while the thermal paper, pressed onto the protective layer 95, is moved in the secondary scanning direction. The current application causes the heat generating resistor 94 to generate heat, whereby desired images and characters can be printed on the thermal paper.

A drawback to printing using the thermal print head X is the sticking phenomenon, in which the thermal paper sticks to the protective layer 95. Such sticking may occur intermittently, thereby causing part of a printed character to be unduly elongated in the primary scanning direction.

Patent Document 1: JP-A-2002-2005

DISCLOSURE OF THE INVENTION

The present invention has been proposed under the above-described circumstances. It is therefore an object of the present invention to provide a thermal print head which is capable of inhibiting occurrence of the sticking phenomenon.

According to the present invention, there is provided a thermal print head including: a substrate; a heat generating resistor supported by the substrate; and a protective layer covering the heat generating resistor. The protective layer includes an inner layer and an outer layer. The inner layer includes a portion that overlaps the heat generating resistor and has a surface roughness of Ra 0.1 through 0.3. The outer layer is made of a metal nitride or a chemical compound containing a metal nitride, and has a thickness of 0.1 through 0.5 μm.

With such an arrangement, a metal nitride or a chemical compound containing a metal nitride constituting the outer layer can prevent thermal paper, which is typically coated with a resin, from causing the sticking. Further, a portion of the inner layer onto which the thermal paper is directly pressed has a roughness of Ra 0.1 through 0.3. Since the outer layer, which covers the inner layer, has a thickness of 0.1 through 0.5 μm, the surface of the outer layer is also a rough surface. Thus, it is possible to provide fine gaps between the thermal paper and the outer layer having a rough surface, and no sticking occurs.

Preferably, the inner layer includes a first layer which covers the heat generating resistor, and a second layer formed on the first layer. The second layer is harder than the first layer and contains carbon. While the thermal print head is being used for a long period, the outer layer may be abraded, causing the inner layer to be exposed. Then, the carbon contained in the inner layer precipitates from the exposed portions. The carbon functions as a lubricant by entering between the protective layer and the thermal paper. Therefore, the thermal print head is suitable for inhibiting generation of the sticking phenomenon even if it is used for a long time to the extent that the outer layer has been abraded.

Other characteristics and advantages of the present invention will become apparent from the detailed description given below with reference to the accompanying drawings.

BEST MODE FOR CARRYING OUT THE INVENTION

Figure 1:
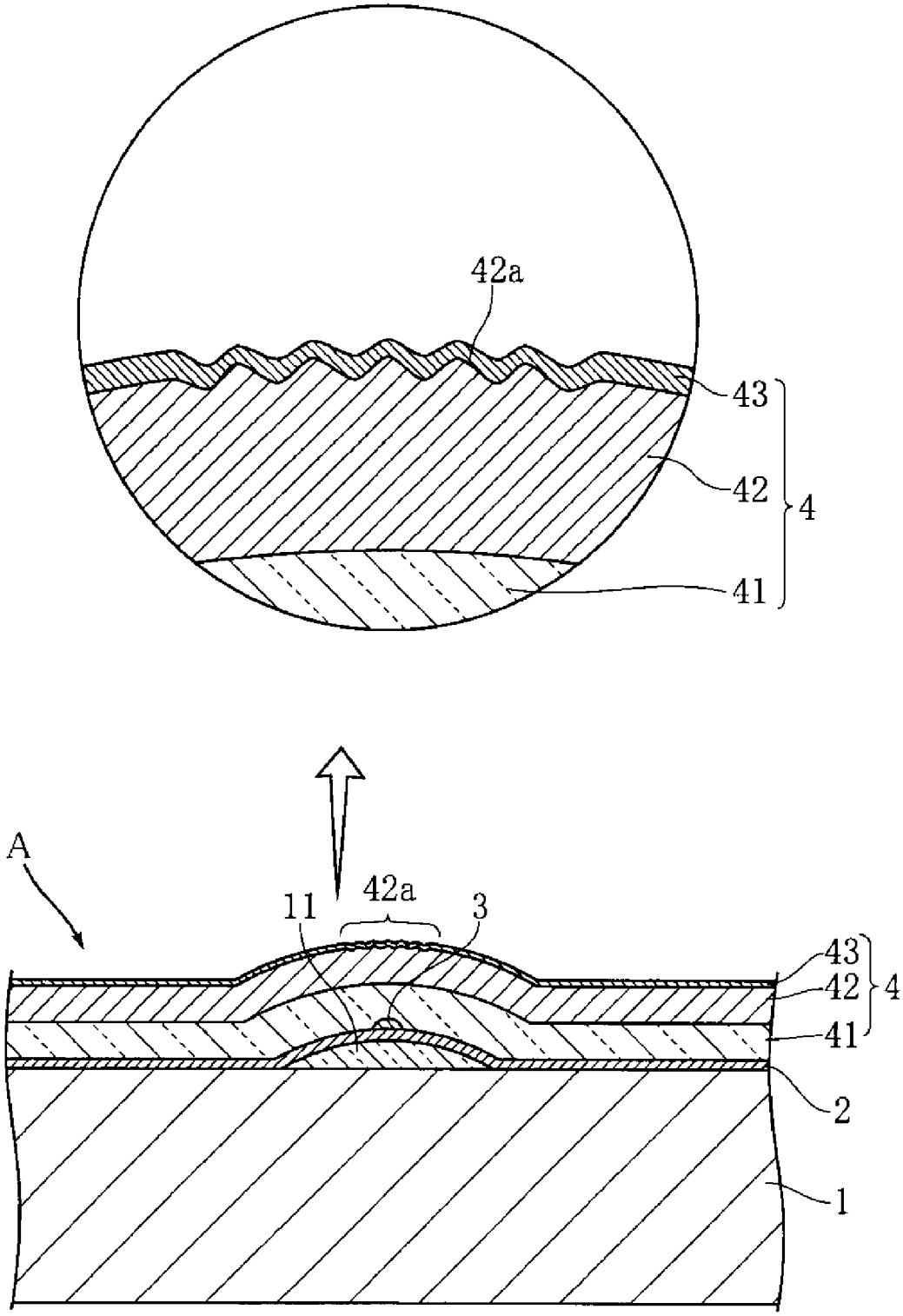
FIG. 1 is a sectional view showing the principal portion of the thermal print head according to the present invention.
Figure 2:
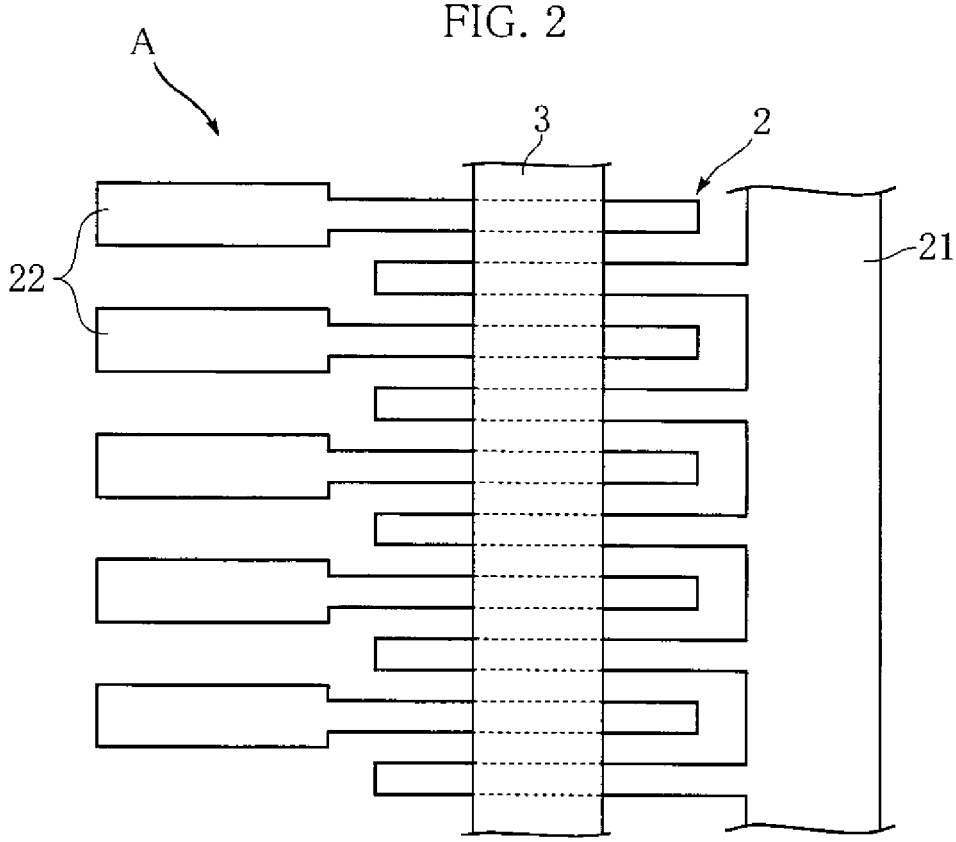
FIG. 2 is a plan view showing an electrode pattern and a heat generating resistor in the thermal print head according to the present invention.

FIG. 1 and FIG. 2 show an example of a thermal print head according to the present invention. The illustrated thermal print head A includes a substrate 1, an electrode pattern 2, a heat generating resistor 3 and a protective layer 4. Only the electrode pattern 2 and the heat generating resistor 3 are depicted in FIG. 2 for easier understanding.

The substrate 1 is an insulated substrate in the shape of an elongate rectangle in a plan view extending in a primary scanning direction, and is made of an alumina ceramic, for example. As shown in FIG. 1, a partial glaze 11 is formed at the upper surface of the substrate 1. The partial glaze 11 is in the shape of an elongate strip extending in the primary scanning direction. The cross section of the partial glaze 11 bulges toward the thickness direction of the substrate 1 (upward in FIG. 1).

The electrode pattern 2 is for applying current to the heat generating resistor 3, and includes a common electrode 21 and a plurality of individual electrodes 22 as shown in FIG. 2. The common electrode 21 includes a primary portion in the shape of an strip extending in the primary scanning direction, and a plurality of branch portions extending from the primary portion in a comb-teeth manner in the secondary scanning direction. The individual electrodes 22 have relatively narrow tip portions, and these tip portions are arranged in the primary scanning direction to alternate with the branch portions. The electrode pattern 2 is formed by applying resinate Au paste on the substrate 1 by thick-film printing, and subsequently baking the applied paste, for example.

The heat generating resistor 3 serves as a heat source for the thermal print head A. The heat generating resistor 3 is in the shape of a strip extending in the primary scanning direction. The heat generating resistor 3 extends across each of the branch portions of the common electrode 21 and each of the tip portions of the individual electrodes 22. Each of the portions of the heat-generating resistor 3 located between two adjacent branch portions functions as an individual heater. Each of the individual heaters is connected with respective one of the individual electrodes 22. When current is applied via the common electrode 21 and a selected one of the individual electrodes 22, the individual heater connected with the selected individual electrodes 22 generates heat. The heat generating resistor 3 is formed by applying a paste of ruthenium oxide by thick-film printing and subsequently baking the paste, for example.

The protective layer 4 covers the heat generating resistor 3, and includes a first inner layer 41, a second inner layer 42 and an outer layer 43.

The first inner layer 41 is made of amorphous glass such as $SiO_2$—ZnO—MgO-based glass, and has a thickness of about 6 μm. The hardness of the first inner layer 41 made of such a material is about 600 Hk. The first inner layer 41 can be formed by applying a glass paste by printing and then baking the paste, for example.

The second inner layer 42 is made of a material, such as SiC, which has a higher thermal conductivity and is harder than the amorphous glass constituting the first inner layer 41, and has a thickness of about 4 μm. The hardness of the second inner layer 42 made of such a material is about 1300 Hk. The second inner layer 42 is formed by e.g. sputtering. The surface of the portion of the second inner layer 42 which overlaps the heat generating resistor 3 provides a rough surface 42*a*. The rough surface 42*a* is provided with a fine undulation and rougher than the peripheral portion. The surface roughness of the rough surface is Ra 1.0 through 0.3.

The outer layer 43 is made of metal nitride or a chemical compound containing metal nitride, and in the present embodiment, made of TaN, for example. The hardness of the outer layer 43 made of such a material is about 1400 through 1500 Hk. The outer layer 43 has a thickness of 0.1 through 0.5 The surface of the portion of the outer layer 43 which is formed on the rough surface 42*a* also provides a finely undulated rough surface like the rough surface 42*a*. The outer layer 43 is formed by sputtering, for example.

Next, advantage of the thermal print head A will be described.

TaN, which forms the outer layer 43, has such a relatively high water repellency, that the water contact angle of TaN is about 60 degrees. Therefore, even if the resin coating on the thermal paper melts, the molten resin coating is repelled by the outer layer 43. Hence, it is possible to prevent resin coating from attaching to the outer layer 43 and therefore possible to inhibit generation of the sticking phenomenon.

Of the three layers constituting the protective layer 4, the outer layer 43 in direct contact with the thermal paper is the hardest. Therefore, if the thermal paper is pressed against the protective layer 4 with large pressing force, the outer layer 43 which is the outermost layer is unlikely to be sheared or deformed. Therefore, even if the thermal paper sticks to the protective layer 4, the paper can be peeled from the outer layer 43 easily. In other words, it is possible to inhibit generation of the sticking phenomenon.

Further, the rough surface 42*a* is disposed at a portion of the protective layer 4 onto which thermal paper is directly pressed. With this arrangement, fine gaps are ensured between the roughened outer layer 43 and the thermal paper, which is advantageous to inhibiting generation of the sticking phenomenon. Since the roughness of the rough surface 42*a* is Ra 0.1 through 0.3, the gaps do not cause a printing trouble such as missing dots.

Figure 3:
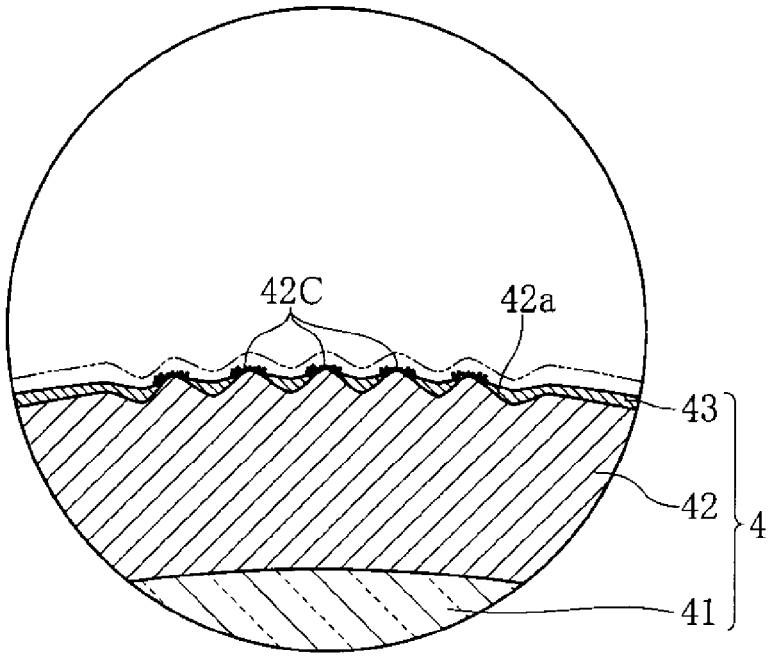
FIG. 3 is a sectional view showing technical advantages produced by the thermal print head according to the present invention.

In addition, generation of the sticking phenomenon is further inhibited due to that the second inner layer 42 is made of a material (SiC) containing C. FIG. 3 shows a state of the thermal print head A after a long period of use. Under this state, convex portions of the outer layer 43 are selectively abraded due to friction with the thermal paper. Further, convex portions of the rough surface 42*a* are exposed through the outer layer 43. From these exposed portions, carbon 42C contained in SiC precipitates. The carbon 42C functions as a lubricant by entering between the thermal paper and the outer layer 43 or the exposed portions of the rough surface 42*a*. Therefore, the thermal print head A is suitable for inhibiting generation of the sticking phenomenon even if it has been used for a long period to the extent that the outer layer 43 has been abraded.

Figure 4:
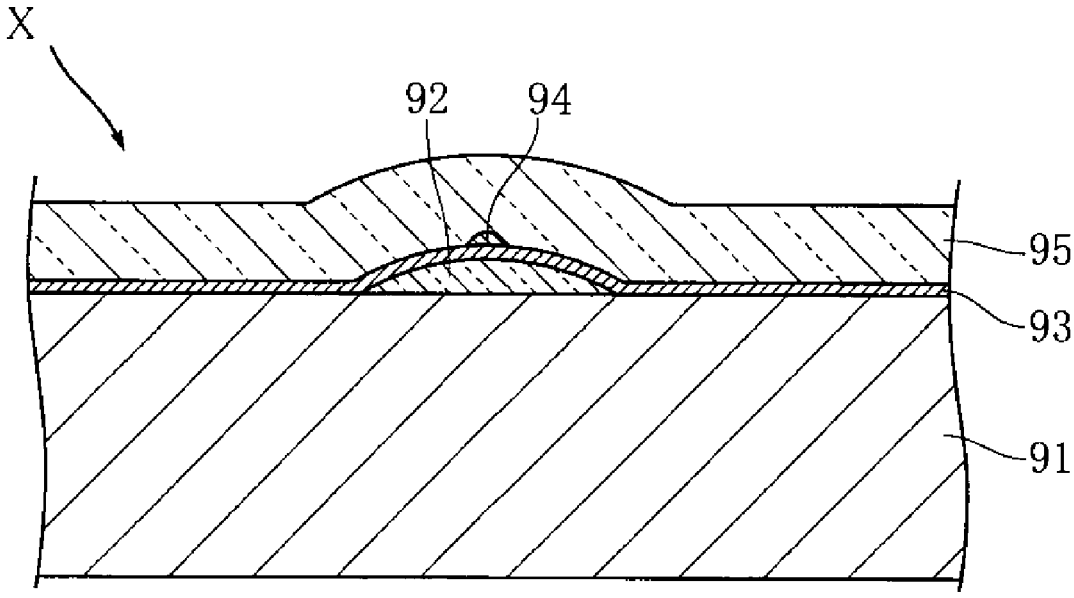
FIG. 4 PRIOR ART
FIG. 4 is a sectional view of an example of a conventional thermal print head.

According to an experiment conducted by the inventors using the arrangement by conventional technique shown in FIG. 4, when thermal paper was fed at a slow speed (e.g. 10.16 cm/second), sticking phenomena frequently occurred. On the contrary, with the thermal print head A according to the present embodiment, when printing was performed at a slow speed of 2.54 cm/second after printing was performed on the thermal paper having a total length of 10 km, sticking phenomenon did not occur.

The thermal print head according to the present invention is not limited to the embodiment described above. Specific arrangements in the thermal print head according to the present invention may be varied in many ways.

The material of the outer layer is not limited to TaN, and may be a chemical compound containing a metal nitride, such as TiN—SiAlON. The material of the second inner layer may be TiC, BC, WC, and so on instead of SiC. If a material containing C is used for the second inner layer, the second inner layer may function as a lubricant. However, such material is not limited to it and may be SiAlON or $Ta_2O_5$. Further, the inner layer may be formed of a single material and may be provided with a rough surface.

The invention claimed is:

1. A thermal print head comprising:

a substrate;

a heat generating resistor supported by the substrate; and a protective layer covering the heat generating resistor; wherein:

the protective layer includes an inner layer and an outer layer;

the inner layer includes a portion overlapping the heat generating resistor and having a surface roughness of Ra 0.1 through 0.3;

the outer layer is made of a metal nitride or a chemical compound containing a metal nitride, and has a thickness of 0.1 through 0.5 μm.

2. The thermal print head according to claim 1, wherein the inner layer includes a first layer covering the heat generating resistor and a second layer formed on the first layer, the second layer being harder than the first layer and containing carbon.

* * * * *